US011684233B2

(12) United States Patent
Vencelj

(10) Patent No.: US 11,684,233 B2
(45) Date of Patent: Jun. 27, 2023

(54) ROTOR FOR A CLEANING MACHINE

(71) Applicant: BRINOX D.O.O., Medvode (SI)

(72) Inventor: Boštjan Vencelj, Šentvid Pri Stični (SI)

(73) Assignee: BRINOX D.O.O., Medvode (SI)

( * ) Notice: Subject to any disclaimer, the term of this patent is extended or adjusted under 35 U.S.C. 154(b) by 514 days.

(21) Appl. No.: 16/633,381

(22) PCT Filed: Jun. 20, 2018

(86) PCT No.: PCT/SI2018/000013

§ 371 (c)(1),
(2) Date: Jan. 24, 2020

(87) PCT Pub. No.: WO2019/022677

PCT Pub. Date: Jan. 31, 2019

(65) Prior Publication Data

US 2020/0229673 A1 Jul. 23, 2020

(30) Foreign Application Priority Data

Jul. 26, 2017 (SI) ..... P-201700219

(51) Int. Cl.

| | |
|---|---|
| ***A47L 15/22*** | (2006.01) |
| ***A47L 15/23*** | (2006.01) |
| ***A47L 15/42*** | (2006.01) |
| ***B05B 1/20*** | (2006.01) |
| ***B05B 3/06*** | (2006.01) |
| ***B07B 1/55*** | (2006.01) |
| ***B08B 3/02*** | (2006.01) |

(52) U.S. Cl.

CPC ..... *A47L 15/23* (2013.01); *A47L 15/22* (2013.01); *A47L 15/4278* (2013.01); *B05B 1/20* (2013.01); *B05B 3/06* (2013.01); *B07B 1/55* (2013.01); *B08B 3/024* (2013.01)

(58) Field of Classification Search

None

See application file for complete search history.

(56) References Cited

U.S. PATENT DOCUMENTS

| | | | | |
|---|---|---|---|---|
| 2,557,206 | A | 6/1951 | Spender | |
| 4,405,087 | A | 9/1983 | Mata-Garza | |
| 2009/0114741 | A1* | 5/2009 | Robert | B05B 15/68 239/289 |

FOREIGN PATENT DOCUMENTS

| | | | |
|---|---|---|---|
| EP | 0174758 | A2 | 3/1986 |
| WO | 9509696 | A1 | 4/1995 |
| WO | 2009058620 | A1 | 5/2009 |

* cited by examiner

*Primary Examiner* — Levon J Shahinian

(74) *Attorney, Agent, or Firm* — Maschoff Brennan

(57) ABSTRACT

The rotor of the invention has two legs fastened to a rotary base, wherein the legs are provided with asymmetrically arranged boreholes facing upwards and boreholes facing downwards, wherein the boreholes facing upwards have the shape of an ellipse, while the boreholes facing downwards have a circular shape. The boreholes facing upwards and the boreholes facing downwards are formed, such that the jets from the boreholes facing upwards act vertically upwards and the jets from the boreholes facing downwards act vertically downwards, i.e., in a direction 90° with respect to the axis of the legs.

5 Claims, 4 Drawing Sheets

View A - A

View D - D

ROTOR FOR A CLEANING MACHINE

The object of the invention is a rotor for a cleaning machine that is used for spraying objects arranged in baskets or directly in the interior of a cleaning machine and other machines with water solutions in small or industrial-size cleaning machines for medical, pharmaceutical, laboratory, food-related or other general purposes. The rotor of the invention has two legs provided with asymmetrically arranged boreholes facing upwards and boreholes facing downwards, wherein the boreholes facing upwards have the form of an ellipse, while the boreholes facing downwards have the form of a circle. The invention belongs to class B08B 3/02 of the International Patent Classification.

The technical problem solved by the present invention is a constructional embodiment of a rotor for a cleaning machine that provides for efficient spraying of objects and rinsing of the interior of a cleaning machine.

Rotors in cleaning machines are arranged in chambers of cleaning machines usually at the top or at the bottom but can also be arranged on all sides of the chamber. Such rotors are also integrated in cleaning baskets and allow spraying of objects arranged in the basket from all sides.

Similar constructional solutions of numerous manufacturers of cleaning machines for medical, pharmaceutical, laboratory and general purposes are known. The technical solutions to rotors so far differ in shape and embodiment and also in the arrangement and shape of boreholes for the discharge of water from rotary rotors.

Patent document EP 2 452 759 discloses a variant, in which the boreholes facing upwards are arranged over the entire rotor on both legs, such that jets from both rotor legs are directed to the same direction along a line parallel to the longitudinal axis at an angle larger than 0° and smaller than 90°. Due to rotor rotation, said solution has a different angle of water jets every 180° with respect to the objects to be cleaned, this is in fact favourable. A drawback of said solution is that the boreholes are made by drilling only without any working of the outlet opening, which results in a reduced flow rate of the water jet. Moreover, the water jet from a cylindrical borehole is smaller than that from an elliptical one.

The rotor of the invention has two legs fastened to a rotary base, wherein the legs are provided with asymmetrically arranged boreholes facing upwards and boreholes facing downwards, wherein the boreholes facing upwards have the form of an ellipse, while the boreholes facing downwards have the form of a circle and allow the jets from the boreholes facing upwards to act vertically upwards, while the jets from the boreholes facing downwards act vertically downwards, i. e. in a direction 90° with respect to the axis of the legs.

Figure 1:
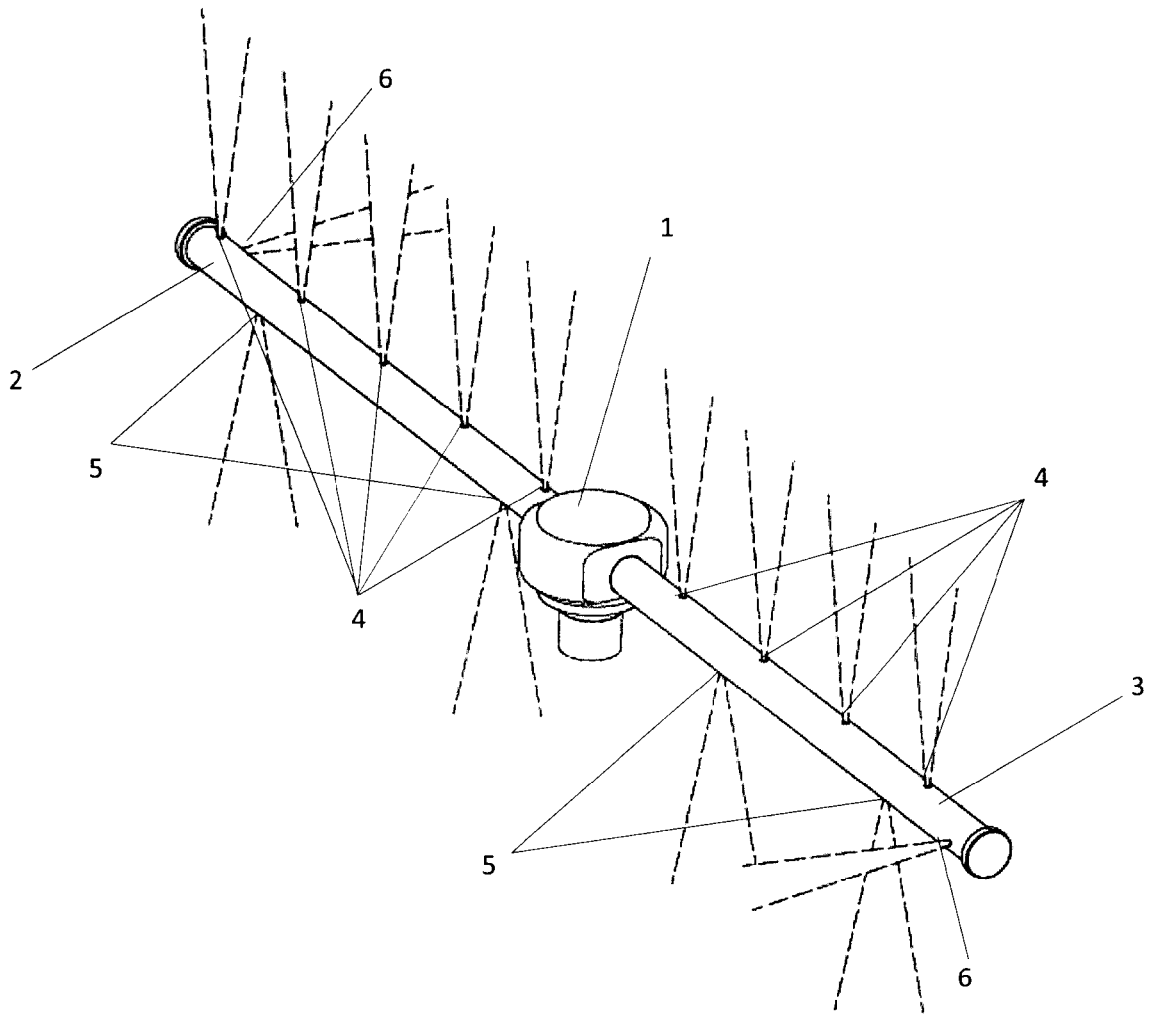
Figure 2:
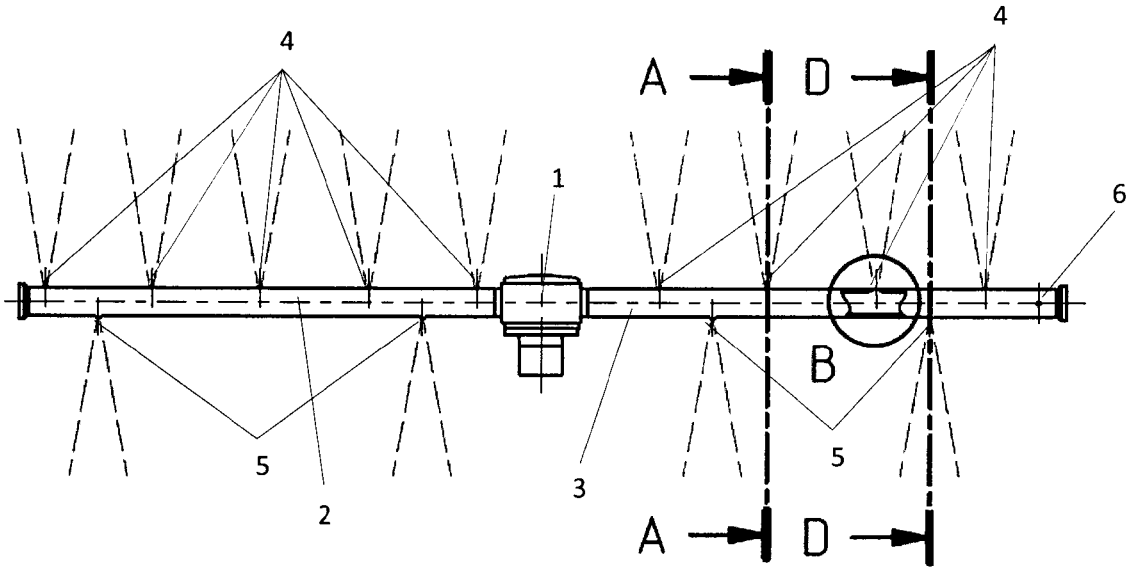
Figure 3:
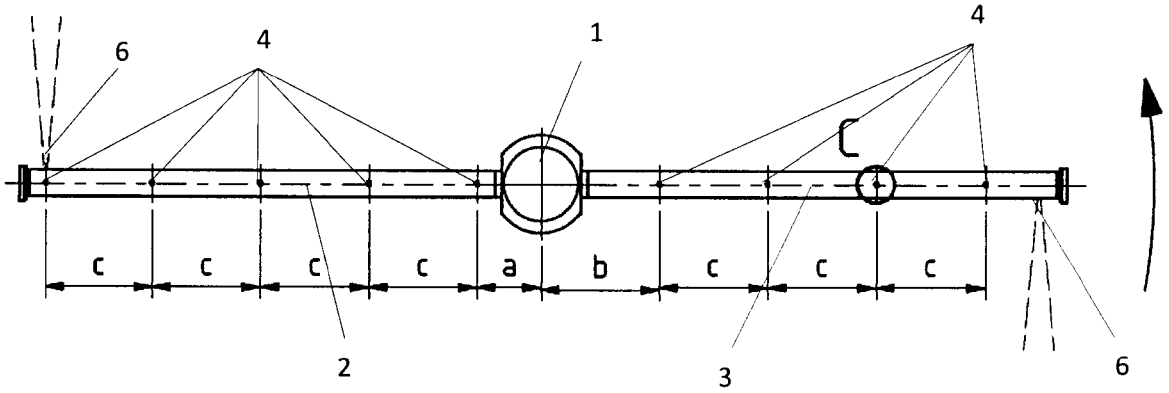
Figure 4:
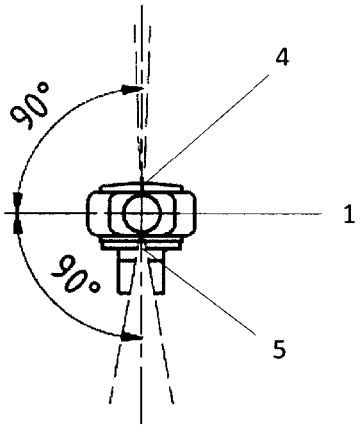
Figure 5:
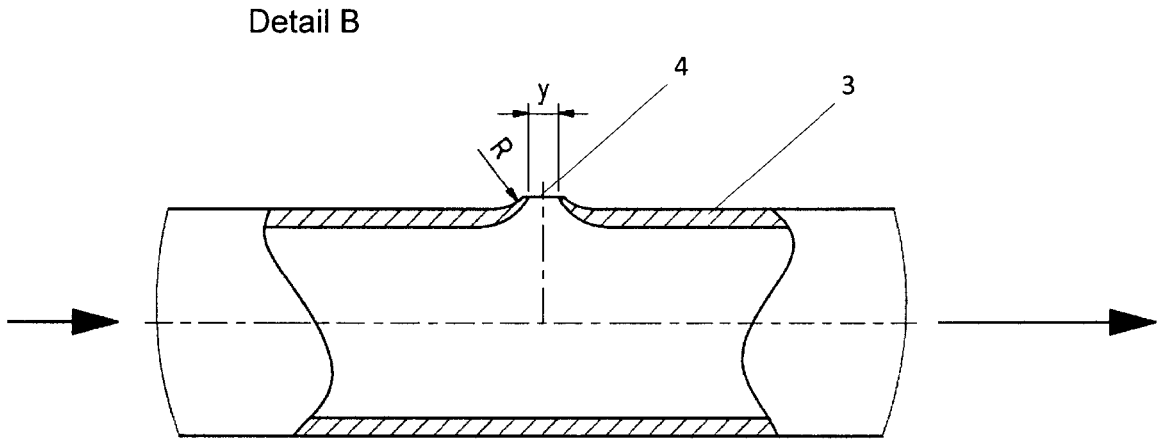
Figure 6:
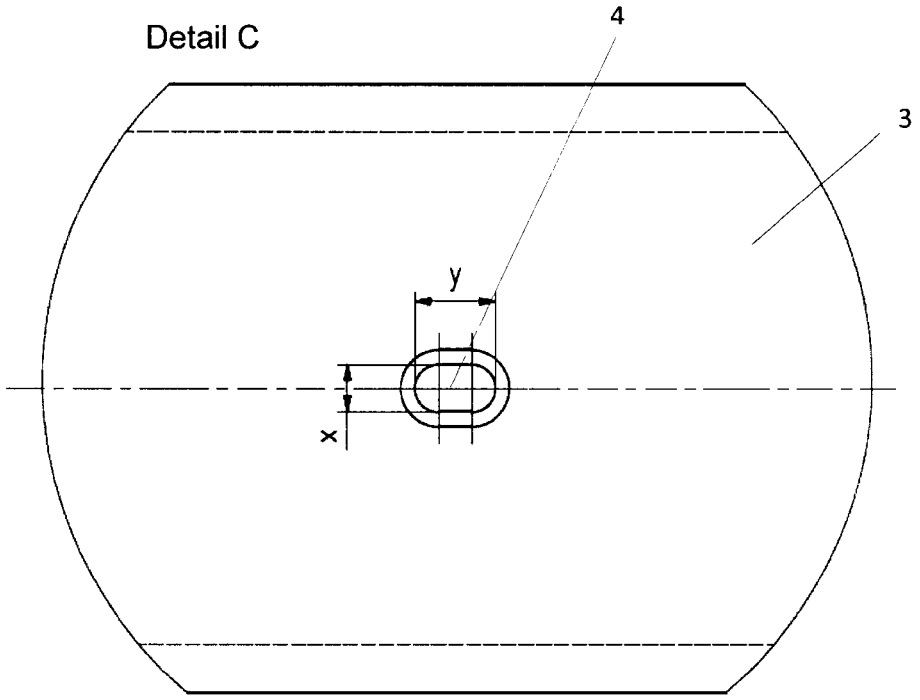
Figure 7:
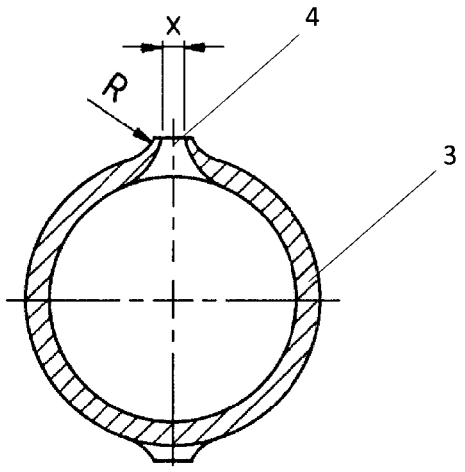
Figure 8:
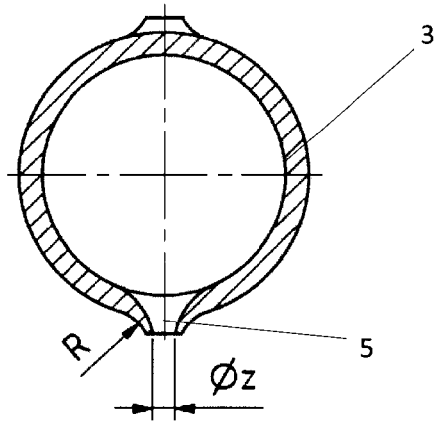

The invention will be explained in more detail by way of an embodiment and the enclosed drawings, representing in:

FIG. 1 rotor of the invention in axonometric view;

FIG. 2 rotor of the invention, side view;

FIG. 3 rotor of the invention, top view, with illustration of distances between individual upper boreholes;

FIG. 4 rotor of the invention, side view, with illustration and position of a jet from the boreholes facing upwards and the boreholes facing downwards;

FIG. 5 Detail B of a leg of the rotor of the invention with illustration of the boreholes facing upwards;

FIG. 6 Detail C of a leg of the rotor of the invention with illustration of the boreholes facing upwards;

FIG. 7 view A-A of the cross-section of a leg of the rotor of the invention with illustration of a borehole facing upwards;

FIG. 8 view D-D of the cross-section of a leg of the rotor of the invention with illustration of a borehole facing downwards.

FIG. 1 shows a rotor for a cleaning machine of the invention in axonometric view. The rotor comprises two legs 2, 3 in the form of a circular tube which are arranged on a rotary base 1, said legs being provided with boreholes for the discharge of water solutions/liquids, more precisely boreholes 4 facing upwards and boreholes 5 facing downwards. The ends of legs 2, 3 of the rotor are further provided with side boreholes 6 used to drive said rotor.

The boreholes 4 and 5 for the discharge of water solutions/liquid from the rotor are formed on the legs 2, 3 in the same line, such that the boreholes 4 facing upwards and the boreholes 5 facing downwards are oriented in a way that the outlet jets from the boreholes 4 facing upwards act vertically upwards and the jects from the boreholes 5 facing downwards act vertically downwards, i. e. in a direction 90° with respect to the axis of the legs 2, 3 (FIG. 4).

The boreholes 4 facing upwards are distributed on the leg 2 at distances c from each other, wherein the first borehole 4, viewed from the top view on the rotor, on the leg 2 is distant from the centre of the rotary base 1 for a distance a, while the first borehole 4, viewed from the top view on the rotor, on the leg 3 is distant from the centre of the rotary base 1 for a distance b. The interdependence of the distances a, b and c is illustrated by the equation and differs in dependence on the size of the rotor.

$$b=a+c/2$$

In this way, the boreholes 4 facing upwards on the legs 2 and 3 are arranged as shown in FIGS. 2 and 3; when the rotor is rotating, the jets from the boreholes 4 facing upwards on the leg 2 and the jets from the boreholes 4 facing upwards on the leg 3 complement each other, thus providing for a thorough cleaning of all surfaces of the objects to be cleaned.

The boreholes 5 facing downwards are arranged on the legs 2, 3 at half the distance c and lie between and exactly 180° opposite the boreholes 4 facing upwards. The boreholes 5 facing downwards serve to spray the chamber walls or to carry out the so-called self-cleaning of the device, what is required in the pharmaceutical industry and should be proved by special procedures.

The boreholes 4 facing upwards are formed by working the material outwards on the spot of tubes of the legs 2, 3, where a discharge spot (outlet from the tube) is then formed, such that the shape of the discharge spots—boreholes 4 facing upwards are of elliptical shape, namely following the equation $$y \geq 1.5x$$

wherein the value y equals the longer distance of the borehole 4 in the form of an ellipse, the value x equals the shorter distance of the borehole 4 in the form of an ellipse (FIGS. 5, 6).

At a certain distance from the discharge spot, the elliptical shape of the outlet jet from the boreholes 4 facing upwards provides for a larger contact surface to be cleaned on the objects in the cleaning machine. In this way, a smaller number of discharge spots are required and better efficiency of the rotary rotor is achieved.

The boreholes 5 facing downwards are formed precisely 180° opposite the boreholes 4 facing upwards and are made by the same technological method only that they have a circular shape.

The boreholes 4, 5 in the legs 2, 3 having the shape of a circular tube are formed by a technological method of drawing that provides for unchanged superficial roughness of the interior of the tube, in which the medium flows, and allows a considerably higher flow rate of the outflowing medium compared to the embodiments, in which a base is welded onto a tube and a nozzle screwed into said base.

The invention claimed is:

1. A rotor for a cleaning machine, comprising:

a first leg in the form of a circular tube formed on a rotary base, the first leg including a first plurality of upward facing boreholes having a first length between each, and the first leg including a first plurality of downward facing boreholes having a second length between each; and a second leg in the form of a circular tube formed on the rotary base, the second leg including a second plurality of upward facing boreholes having the first length between each and asymmetric with respect to the first plurality of upward facing boreholes relative to the rotary base, and the second leg including a second plurality of downward facing boreholes having a third length between each, wherein:

first jets from the first plurality of upward facing boreholes and the second plurality of upward facing boreholes act vertically upwards and second jets from the first plurality of downward facing boreholes and the second plurality of downward facing boreholes act vertically downwards, each in a direction 90° with respect to the axis of the first leg and the second leg, the first length is (c), a first upward borehole of the first plurality of upward facing boreholes, based on a top view of the rotor, is distant from the center of the rotary base a first distance (a), a second upward borehole of the second plurality of upward facing boreholes, based on the top view of the rotor, is distant from the center of the rotary base a second distance (b), and $(b)=(a)+(c)/2$.

2. The rotor for a cleaning machine according to claim 1, wherein:

the first plurality of upward facing boreholes and the second plurality of upward facing boreholes have the shape of an ellipse, and the first plurality of downward facing boreholes and the second plurality of downward facing boreholes have a circular shape.

3. The rotor for a cleaning machine according to claim 2, wherein:

a major axis length of the ellipse is at least one and one-half times a minor axis length of the ellipse.

4. The rotor for a cleaning machine according to claim 1, wherein:

a first downward borehole of the first plurality of downward facing boreholes is disposed the first distance plus half the first length (e.g., (a)+(c)/2) from the center of the rotary base, a second downward borehole of the first plurality of downward facing boreholes is disposed two times the first length from the first downward borehole (e.g., 2*(c)+((a)+(c)/2)) from the center of the rotary base, a third downward borehole of the second plurality of downward facing boreholes is disposed the second distance plus half the first length (e.g., (b)+(c)/2) from the center of the rotary base, a fourth downward borehole of the second plurality of downward facing boreholes is disposed three times the first length from the third downward borehole (e.g., 3*(c)+((b)+(c)/2)) from the center of the rotary base, and the second jets act exactly 180° opposite the first jets of the first plurality of upward facing boreholes and the second plurality of upward facing boreholes.

5. The rotor for a cleaning machine according to claim 1, wherein:

the first plurality of upward facing boreholes, the second plurality of upward facing boreholes, the first plurality of downward facing boreholes, and the second plurality of downward facing boreholes are formed by a method of drawing from a tube.

* * * * *